United States Patent [19]

Field

[11] 4,353,241

[45] Oct. 12, 1982

[54] APPARATUS FOR REPAIRING AND STRAIGHTENING VEHICLES

[76] Inventor: Carl R. Field, 2900 E. 38th, Des Moines, Iowa 50317

[21] Appl. No.: 113,793

[22] Filed: Jan. 21, 1980

[51] Int. Cl.[3] ..... B21D 1/12

[52] U.S. Cl. ..... 72/457; 72/705

[58] Field of Search ..... 72/705, 457

[56] References Cited

U.S. PATENT DOCUMENTS

| | | | |
|---|---|---|---|
| 1,251,015 | 12/1917 | Gross | 72/705 |
| 3,122,194 | 2/1964 | Bronson et al. | 72/705 |
| 3,206,966 | 9/1965 | Fagan et al. | 72/705 |
| 3,269,169 | 8/1966 | Latuff et al. | 72/705 |
| 3,377,834 | 4/1968 | Latuff et al. | 72/705 |
| 3,888,100 | 6/1975 | Chisum | 72/705 |
| 4,088,006 | 5/1978 | Patten | 72/705 |
| 4,138,877 | 2/1979 | Specktor | 72/705 |
| 4,247,966 | 2/1981 | Labbe | 24/116 R |

FOREIGN PATENT DOCUMENTS

| | | | |
|---|---|---|---|
| 255547 | 4/1964 | Australia | 72/705 |

*Primary Examiner*—Lowell A. Larson
*Attorney, Agent, or Firm*—Zarley, McKee, Thomte, Voorhees & Sease

[57] ABSTRACT

An apparatus for repairing and straightening vehicles includes upper and lower tracks supported in vertically spaced relation by a frame, each track including a pair of latterally spaced apart and longitudinally extended side members. A plurality of tower assemblies are supported on the upper and lower tracks for longitudinal movement therealong. Each tower assembly includes a flexible tension member adapted for securement to a vehicle positioned between the side members and a power source for pulling the tension member toward the tower assembly to thereby straighten the vehicle. The track supporting frame includes a superstructure above the upper track and a plurality of upper pulleys adjustably mounted on the superstructure whereby each tension member may be trained about one of the upper pulleys for exerting a pulling force on the vehicle from an elevation above the upper track. The tracks may be generally U-shaped so as to be open at the rearward end to provide for the entry of a vehicle into position between the side members. Each tower assembly may be secured against longitudinal movement along the tracks by a bearing surface connected thereto adjacent the upper track. The bearing surface is adapted for bearing engagement against the upper track in response to the application of tension to the tension member.

4 Claims, 10 Drawing Figures

3.
4.
10.

APPARATUS FOR REPAIRING AND STRAIGHTENING VEHICLES

BACKGROUND OF THE INVENTION

The present invention is directed generally to apparatus for repairing and straightening vehicles and more particularly to a heavy duty truck straightening apparatus adapted to provide for the facilitated entry of a large truck therein and the application of forces from sufficient heights to straighten the body thereof.

Several vehicle body straightening apparatus are commercially available but these are generally specially constructed for the repair of automobile bodies and include several heretofore unresolved problems. The existing apparatus generally include a plurality of towers movably positioned about a vehicle with each tower having a chain connected to the vehicle for exerting a pulling force toward the tower. The towers have been supported for revolution about a center pivot point but this arrangement does not accomodate proper positioning of the towers relative to an elongated truck body. Likewise, the towers generally do not provide for the application of forces from sufficient heights to straighten certain truck body parts.

In apparatus wherein the towers are movably supported on tracks around the vehicle to be straightened, a vertically adjustable ramp or the like is often required for the entry of a vehicle therein. Such an arrangement is impractical for the larger and less maneuverable trucks. Finally, the securement of the towers at desired positions along the track has generally required a bolt or stop pin arrangement which is inconvenient and time consuming to apply for each tower. Latuff et al. U.S. Pat. No. 3,377,834 shows a first embodiment including such a stop pin arrangement and a second embodiment wherein a semi-cylindrical portion of the tower bears against a flat truck. These and other problems associated with the prior art are believed to be solved by the vehicle repairing and straightening apparatus of the present invention.

Accordingly, it is a primary object of the present invention to provide an improved apparatus for repairing and straightening vehicles.

A further object is to provide a vehicle straightening apparatus adapted to accommodate large trucks.

A further object is to provide a vehicle straightening apparatus including means for exerting pulling forces from heights above the towers thereof.

A further object is to provide a vehicle straightening apparatus over a pit which provides access for the operator and wherein the vehicle is stationed on the floor rather than on a platform whereby no stepping up and down from a platform is required.

A further object is to provide a vehicle straightening apparatus which vehicles can easily enter and exit from.

A more specific object is to provide a vehicle straightening apparatus including a two-tiered generally U-shaped track arrangement open at one end for the entry and exit of vehicles therethrough.

A further object of the invention is to provide a vehicle straightening apparatus adapted for easy one man operation.

A further object is to provide a vehicle straightening apparatus wherein each tower is secured in position along its track by friction between the track and a parallel bearing surface on the tower.

A further object is to provide a portable floor beam adapted to be moved along the length of the apparatus and rotatable for horizontal or vertical forces being applied thereto.

A further object is to provide an overhead hoist movable the length of the apparatus and to either side.

These and other objects of the present invention will be apparent to those skilled in the art from the following description of the invention.

DESCRIPTION OF THE PREFERRED EMBODIMENT

Figures 1, 2, 10:
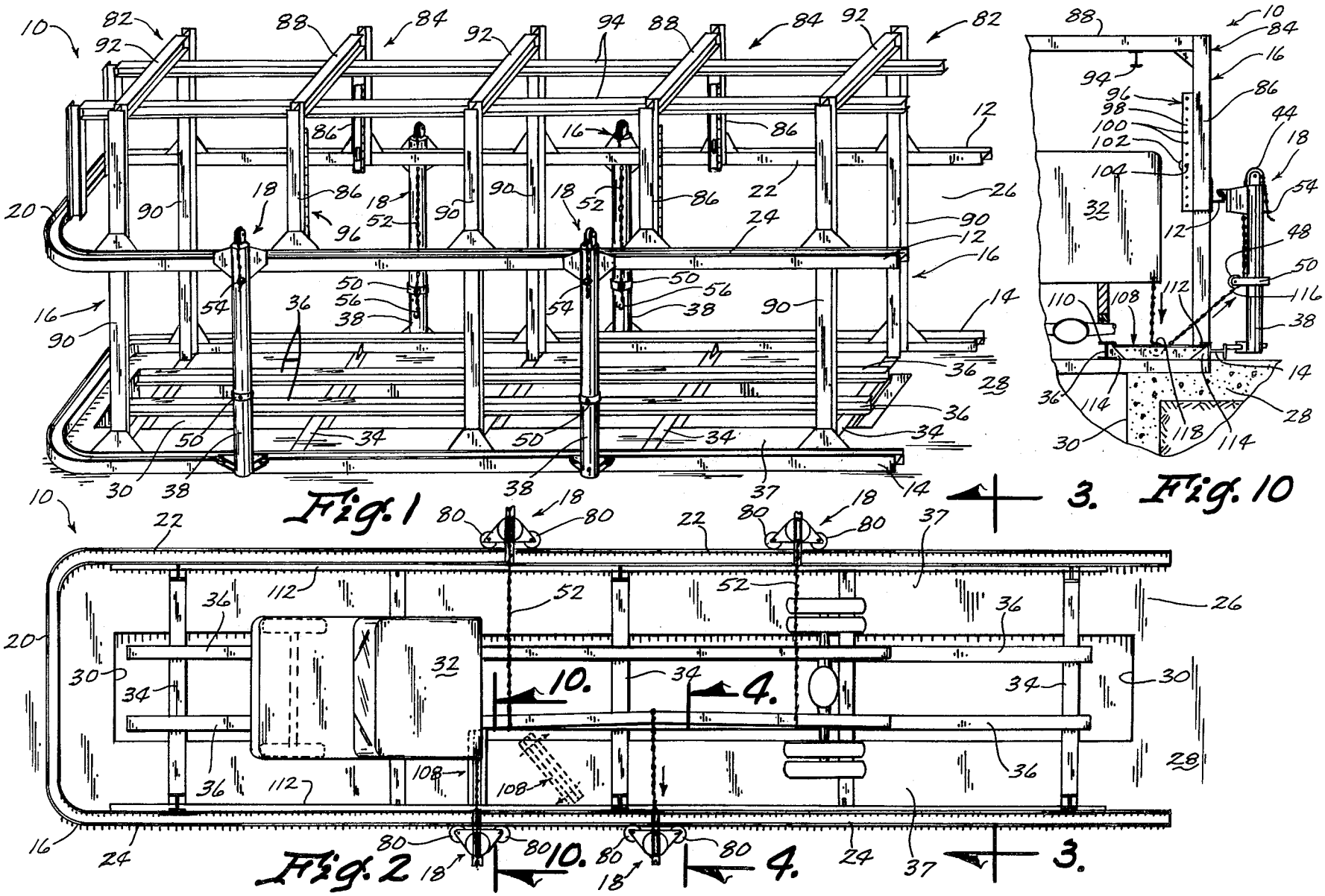
FIG. 1 is a perspective side view of the vehicle straightening apparatus of the invention.
FIG. 2 is an enlarged top view of the vehicle straightening apparatus including a truck chassis positioned therein.
FIG. 10 is a cross sectional view taken along line 10—10 in FIG. 2 illustrating the use of the portable floor beam.

The vehicle straightening apparatus of the present invention, indicated generally at 10 in FIG. 1, includes upper and lower generally U-shaped tracks 12 and 14 respectively which are supported by longitudinally spaced apart inverted U-shaped frame sections 16. A plurality of upright towers 18 are movable along the tracks and each includes a chain adapted for connection to a vehicle and means for pulling the chain toward the tower for straightening the vehicle.

In the preferred embodiment, the upper and lower tracks 12 and 14 are substantially identical although it is apparent that in other embodiments, they may be of different shapes or sizes to accommodate particular tower structures. Only upper track 12 will thus be described in detail with reference to FIG. 2 wherein the track includes a laterally extended front cross member 20 and a pair of side members 22 and 24 connected to opposite ends of the front cross member and extended longitudinally rearwardly therefrom. The rearward end of the track is open as at 26 to provide for the entry of a vehicle into position between the side members 22 and 24.

Figures 3, 4, 5, 6, 7, 8, 9:
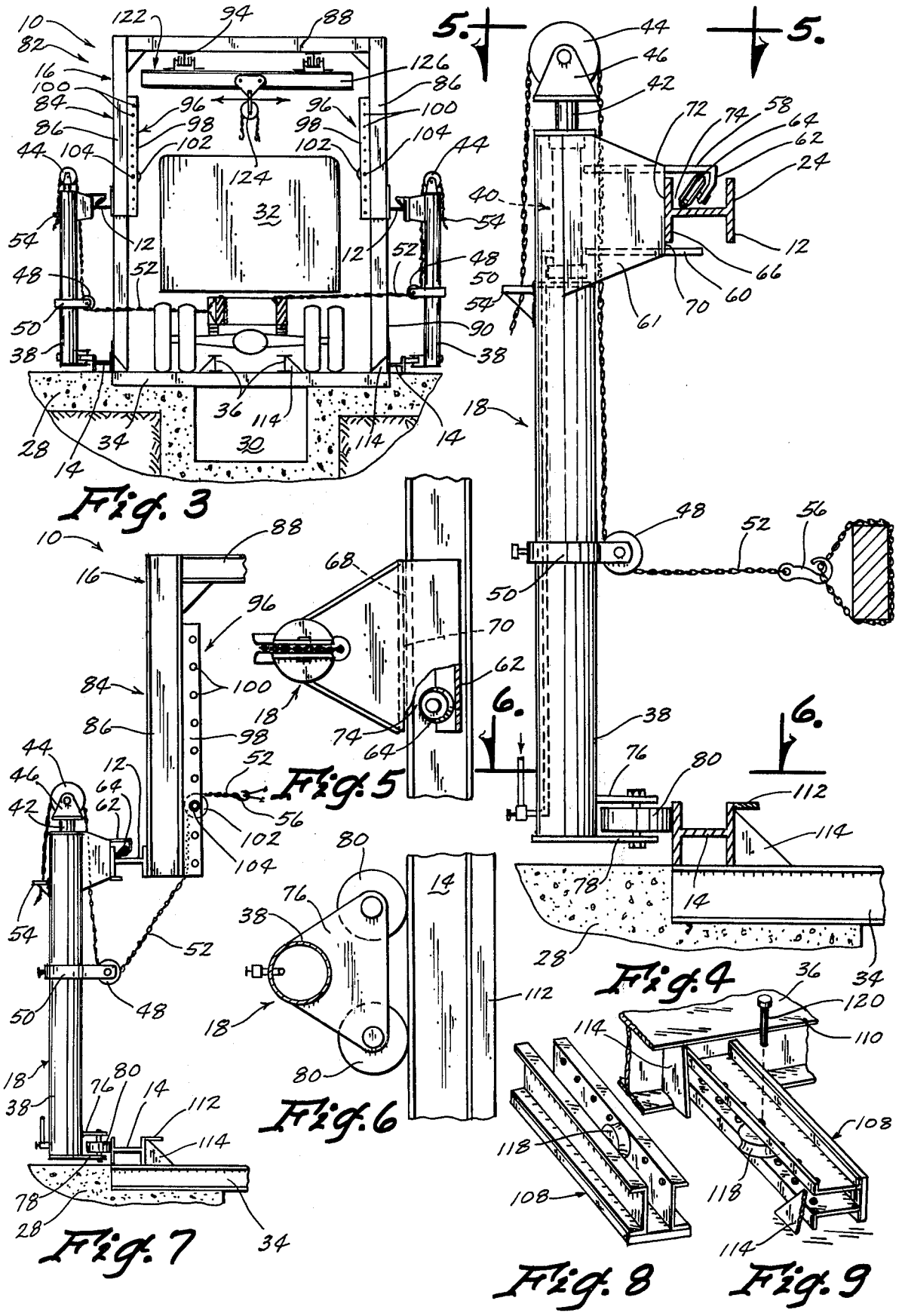
FIG. 3 is a partially sectional elevational end view taken along line 3—3 in FIG. 2.
FIG. 4 is an enlarged detail sectional view of the tower and track arrangement as seen on line 4—4 in FIG. 2.
FIG. 5 is a detailed top view as seen on line 5—5 in FIG. 4.
FIG. 6 is a top partially sectional view of the tower and lower track arrangement as seen on line 6—6 in FIG. 4.
FIG. 7 is an enlarged fragmented end view of one side of the invention.
FIG. 8 is a perspective view of the portable floor beam vertically disposed.
FIG. 9 is a perspective view of the portable floor beam horizontally disposed and engaging gusset plates of beams mounted in the floor.

In FIGS. 1 and 3, it is seen that the apparatus 10 is constructed on a foundation 28 including an elongated pit 30 positioned between the track side members for providing access to the underside of a truck 32 positioned within the apparatus. A plurality of cross members 34 extend laterally across the top of pit 30 for supporting a pair of longitudinally extended rails 36 which are spaced apart by the same distance as the side bars of most large truck frames. The rails are convenient for applying vertical tie-downs to the truck for certain straightening operations. There is sufficient clearance between the sides of pit 30 and the side members of lower track 14 to permit a vehicle to be driven into the apparatus with its wheels supported on the surface 37 therebetween.

Each tower or tower assembly 18 includes an upright tubular base member 38 which houses an extensible and retractable hydraulic cylinder unit 40 therein. The piston 42 protrudes from the upper end of base member 38 and has a first pulley 44 rotatably mounted on the upper end thereof by a bracket 46. A second pulley 48 is rotatable supported about a horizontal axis on the interior side of base member 38 by a vertically adjustable collar 50. The terms interior and exterior are used herein with reference to the apparatus 10 so that interior means toward a vehicle positioned within the apparatus. A flexible tension member 52 such as a chain, wire cable or the like is secured at one end to an anchor lock bracket 54 on the exterior side of base member 38 with a medial portion of the chain trained about the top side of first pulley 44 and underside of second pulley 48 for extension of the free end 56 thereof interiorly for connection to the truck 32. Upon extension of hydraulic cylinder unit 40, the free end 56 of chain 52 is pulled toward the second pulley 48 for straightening the truck frame. In FIG. 2, it is seen that a pair of towers on one side of the apparatus 10 have chains connected to the truck for stabilizing the same so that the pulling force of the tower on the opposite side of the apparatus is directed toward the damaged area of the vehicle.

To support each tower 18 on the upper and lower tracks 12 and 14, the upper end of each base member 38 includes a pair of vertically spaced apart interiorly flared plates 58 and 60 which are welded to the base member and reinforced by vertical gussets 61. Top plate 58 includes a down turned and exteriorly bent end portion 62 which rotatably supports a pair of longitudinally spaced apart rollers 64 on the exterior side thereof. In FIG. 4, it is seen that the rollers 64 ride on the horizontal web of the I-beam shaped upper track 12 for vertically supporting the tower 18 thereon. Since both upper and lower plates 58 and 60 extend interiorly of at least a portion of upper track 12, the vertical movement of the tower is additionally limited by the abutment of these plates with the exterior vertical side flange 66 of upper track 14 although rollers 64 normally support the tower so that both plates are maintained in clearance relation from flange 66.

An additional vertical plate 68 having an interior bearing surface 70 is secured between plates 58 and 60 adjacent the upper track exterior flange 66. It is seen that vertical plate 68 limits interior movement of tower 18 by bearing against the exterior friction surface 72 of upper track flange 66. Upon the application of tension to the chain 52 by the extension of hydraulic cylinder unit 40, sufficient friction is developed between the tower bearing surface 70 and the track friction surface 72 to secure the tower in a fixed longitudinal position along the upper track 12. This is largely due to the parallel relation and relatively large area of the surfaces which become engaged when the tower is urged toward the rail by chain 52.

On the other hand, when tension is not being applied to the chain 52, the tower 18 is easily rolled along the upper track 12 substantially free from friction from the surfaces 70 and 72. This is because of the clearance space 74 between the roller 64 and exterior track flange 66 (FIG. 4) which permits of sufficient exterior movement of the tower to separate the surfaces 70 and 72.

The lower end of tower 18, as shown in FIGS. 4 and 6, includes a pair of interiorly flared wheel support plates 76 and 78 between which a pair of horizontally disposed rollers 80 are supported about vertical axes at longitudinally spaced apart positions for rolling engagement against the exterior surface of lower track 14.

It is important to be able to vertically adjust the position from which a pulling force is exerted on the truck 32. Since the truck may be taller than the towers 18 however, the vertical adjustment of collars 50 is insufficient to provide the necessary range of vertical adjustment. For this purpose, the frame of the present invention includes a superstructure indicated generally at 82 which extends upwardly above the upper track 12. Referring to FIGS. 1 and 3, the superstructure 82 includes a plurality of inverted generally U-shaped pulley support sections 84, each including a pair of upper posts 86 secured to opposite members of the upper track 12, and a top frame member 88 connected to and extended between the tops of the upper posts 86. Note that the frame sections 16 also include upright frame posts 90 secured to the interior side of the upper and lower tracks 12 and 14 and extended upwardly from the upper track, and a top frame member 92 connected between opposite frame posts. A pair of elongated brace members 94 interconnect the top frame members 88 and 92 for reinforcing the same.

Each upper post 86 includes an upright channel section 96 (FIG. 7) on the interior side thereof which opens toward the opposite track side member. Each channel section 96 includes spaced apart side flanges 98 which may be formed by a pair of oppositely disposed channel members as indicated in FIG. 8. The side flanges 98 are provided with vertically spaced openings 100. An upper pulley 102 is rotatably supported between a selected pair of openings 100 by a pin 104.

In FIGS. 2 and 8–10 the portable beam 108 is positioned between the lower track 14 and the adjacent rail 36 by its ends being placed under the flange 110 on the rail 36 and under an add-on flange 112, best seen in FIG. 7, extending horizontally inwardly from the top side surface of the lower track 14. Gussets 114 spaced along the length of the lower track and rails 36 provides stops against which the portable beams abut to limit horizontal travel. The beams 108 are easily put in place or removed by simply turning them sufficiently to engage or disengage the lower track and rails 14 and 36, respectively, as seen by the dash line representation of the portable beam in FIG. 2.

In FIG. 10 it is seen that a chain 116 extends from the truck cab 32 downwardly around a pulley 118 on the beam 108 thence upwardly and outwardly to a pulley 48 wherein the pull is applied as previously discussed. The pulley 118 is adapted to be positioned anywhere along the length of the beam 108 by use of the removable pin 120. In FIG. 9 it is seen that the beam 108 is turned 90° then is abutted up against the gussets 114 which function as a stop to resist horizontal movement. Horizontal and vertical forces can be applied to the portable beam 108 in this position.

In FIG. 3 an overhead hoist assembly 122 is provided and includes a chain 124 movably carried on a transversely extending beam 126 which in turn is movable longitudinally on the rail members 94. Thus, lifting forces may be applied to the vehicle 32 at any point along its length or width.

Thus, referring to FIG. 7, it is seen that the chain 52 may be extended upwardly from second pulley 48 to be trained about the top side of upper pulley 102 for exerting a pulling force on the truck 32 from an elevation above the upper track 12.

The term pulley is intended to be broadly construed as including gears, sprockets or other such rotatable members as may be provided for effecting a change in direction of the chain 52 or other such flexible tension member as may be provided.

The apparatus for repairing and straightening vehicles according to the present invention is particularly adapted for the repair of large trucks. The two-tiered and open ended U-shape of the tracks enables the trucks to be driven into and out of the apparatus at ground level and without interference from either track. An operator can quickly roll the towers along the tracks to the desired positions for connection of the chains to the truck body. Upon the application of tension of the chain of a given tower by the extension of the hydraulic cylinder unit of the same or an oppositely disposed tower, the tower is secured against longitudinal movement along the tracks by the frictional bearing engagement between the tower bearing surface 70 and the upper track friction surface 72. Similarly, once the tension in the chain is relaxed, the limited lateral freeplay of the tower relative to the track enables the contact surfaces to separate so that the towers may again be easily moved to alternate positions for another operation. Finally, the superstructure 82 including the overhead hoist assembly 122, combined with the portable beams 108, enables the chains to exert pulling forces on the truck body directly upwardly or downwardly or from the side at any desired elevation including the points above the height of the towers as is often necessary for repairs to truck bodies.

It should be noted that as seen in FIG. 2, the chains 52 connected to the towers 18 extend perpendicularly inwardly rather than at an angle since there is no need for any angular pulls on the towers as the towers can be moved to any position directly opposite to the connection to the vehicle. Accordingly, the towers do not need to rotate to allow for angular pulls but instead are simply moved to a point directly opposite the connection to the vehicle. In this regard the pulley bracket 46 and the collar 50, as seen in FIG. 4, can be locked against rotational movement as such is not required for operation of the towers 18.

Thus there has been shown and described an apparatus for repairing and straightening vehicles which accomplishes at least all of the stated objects.

I claim:

1. Apparatus for repairing and straightening vehicles, comprising, upper and lower track means, each track means including a pair of laterally spaced apart and longitudinally extended side members, frame means connected to said upper and lower track means for supporting said upper track means in vertically spaced relation above said lower track means, a plurality of tower assemblies, means for supporting each tower assembly on said upper and lower tracks for longitudinal movement therealong, each tower assembly including an upright tower, a lower pulley means, means for vertically adjustably mounting said lower pulley means on said tower at selected positions between an uppermost adjusted position adjacent said upper track means and a lowermost adjusted position adjacent said lower track means, a flexible tension member having a free end adapted for securement to a vehicle positioned between said side members and an opposite end portion trained about said plurality means and connected to said tower, and power means for pulling said tension member toward the tower thereby to straighten a vehicle connected to the free end of said tensison member, said frame means including a superstructure above said upper track means, a plurality of upper pulley means and means for vertically adjustably mounting said upper pulley means on said superstructure at positions above said uppermost adjusted position of said lower pulley means, each tension member being adapted to be trained about one of said upper pulley means for exerting a pulling force on a vehicle from an elevation above said upper track means, said superstructure including a plurality of inverted generally U-shaped pulley support sections, each including a pair of upper posts secured to opposite side members of said upper track means and extended upwardly therefrom, and a top frame member connected to and extended between said upper posts above said upper track means, said upper pulley means being adjustably mounted on said upper posts, said frame means comprising a plurality of inverted generally U-shaped frame sections, each including a pair of laterally spaced apart frame posts secured to said upper and lower tracks and extended upwardly from said upper track and a top frame member connected between said frame posts above said upper track, said upper posts of said superstructure being arranged in longitudinally spaced relation from said frame posts of said frame means whereby said frame posts are disposed in noninterfering relation with a tension member trained about one of said upper pulley means.

2. An apparatus for repairing and straightening vehicles, comprising, upper and lower generally U-shaped tracks having forward and rearward ends, each track including a laterally extending front cross member and a pair of side members connected to opposite ends of the respective front cross member and extending longitudinally rearwardly therefrom, the rearward end of each track being open to provide for the entry of a vehicle into position between said side members, frame means connected to and extended between said upper and lower tracks to support said upper track in vertically spaced relation above said lower track, a plurality of tower assemblies, means for supporting each tower assembly on said upper and lower tracks for movement therealong, each tower assembly including an upright tower, a flexible tension member having a free end adapted for securement to a vehicle positioned between said side members and an opposite end portion connected to said tower, and power means for pulling said tension member toward the tower thereby to straighten a vehicle connected to the free end of said tension member, a pair of rails extending parallel to said lower tracks and in a common horizontal plane, a longitudinally movable beam being provided between adjacent lower tracks and said pair of rails and being limited against vertical movement by horizontal flanges facing each other on said tracks and pair of rails, and a plurality of pairs of abutment means fixed to said lower tracks and said pair of rails in longitudinally spaced apart relation and extended therefrom to limit longitudinal travel of said movable beam, a pulley means being provided on said movable beam for engaging said tension member adapted to extend from said tower to a vehicle to provide a downward pull on the vehicle, and means for laterally adjustably mounting said pulley means on said movable beam for lateral adjustment of said pulley means relative to a vehicle positioned between said side members.

3. The structure of claim 2 wherein a superstructure is provided above said upper track means interconnecting said oppositely disposed frame means, and a hoist means on said superstructure is movable longitudinally and laterally of a vehicle thereunder for applying upward stress forces on the vehicle.

4. An apparatus for repairing and straightening vehicles, comprising, upper and lower tracks having forward and rearward ends, each track including a laterally extending front cross member and a pair of side members connected to opposite ends of the respective front cross member and extending longitudinally rearwardly therefrom, the rearward end of each track being open to provide for the entry of a vehicle into position between said side members, frame means connected to and extended between said upper and lower tracks to support said upper track in vertically spaced relation above said lower track, a plurality of tower assemblies, means for supporting each tower assembly on said upper and lower tracks for movement therealong, each tower assembly including an upright tower, a flexible tension member having a free end adapted for securement to a vehicle positioned between said side members and an opposite end portion connected to said tower, and power means for pulling said tension member toward the tower thereby to straighten a vehicle connected to the free end of said tension member, a pair of rails extending parallel to said lower tracks and in a common horizontal plane, a longitudinally movable beam being provided between adjacent lower tracks and said pair of rails and being limited against vertical movement by horizontal flanges facing each other on said tracks and pair of rails, and a plurality of pairs of abutment means fixed to said lower tracks and said pair of rails in longitudinally spaced apart relation and extended therefrom to limit longitudinal travel of said movable beam, a pulley means being provided on said movable beam for engaging said tension member adapted to extend from said tower to a vehicle to provide a downward pull on the vehicle, and means for laterally adjustably mounting said pulley means on said movable beam for lateral adjustment of said pulley means relative to a vehicle positioned between said side members.

* * * * *

UNITED STATES PATENT AND TRADEMARK OFFICE

CERTIFICATE OF CORRECTION

PATENT NO. : 4,353,241

DATED : October 12, 1982

INVENTOR(S) : Carl R. Field

It is certified that error appears in the above—identified patent and that said Letters Patent is hereby corrected as shown below:

Column 6, line 10, "plurality" should read --pulley--

Signed and Sealed this

*Thirteenth* Day of *May 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,353,241

DATED : October 12, 1982

INVENTOR(S) : Carl R. Field

It is certified that error appears in the above—identified patent and that said Letters Patent is hereby corrected as shown below:

Column 6, line 14, "tensison" should read

--tension--

Signed and Sealed this

*Ninth* Day of *September 1986*

[SEAL]

*Attest:*

DONALD J. QUIGG

*Attesting Officer*

*Commissioner of Patents and Trademarks*